United States Patent [19]

Halliday, Jr. et al.

[11] 4,032,773

[45] June 28, 1977

[54] FLASHLIGHT

[75] Inventors: Richard L. Halliday, Jr., Fountainville; Robert R. Anderson, Dublin; Richard L. Halliday, Doylestown, all of Pa.

[73] Assignee: Halliday & Co., Inc., Doylestown, Pa.

[22] Filed: Dec. 18, 1975

[21] Appl. No.: 642,013

[52] U.S. Cl. ..... 240/10.6 R; 240/25; 240/10.65

[51] Int. Cl.[2] ..... F21L 7/00

[58] Field of Search ..... 240/10.66, 10.6, 10.65, 240/10.68, 25, 2.25

[56] References Cited

UNITED STATES PATENTS

| | | | |
|---|---|---|---|
| 2,295,071 | 9/1942 | Ansley | 240/10.65 X |
| 2,848,598 | 8/1958 | Amlee | 240/10.66 |
| 2,853,832 | 9/1958 | Arena | 240/10.65 X |
| 3,206,594 | 9/1965 | Brown | 240/10.65 |
| 3,787,677 | 1/1974 | Molitor | 240/10.65 |
| 3,796,869 | 3/1974 | Stone | 240/2.25 |

*Primary Examiner*—Edna M. O'Connor
*Attorney, Agent, or Firm*—John W. Logan, Jr.

[57] ABSTRACT

A flashlight in accordance with the preferred embodiment of the invention includes a housing enclosing a battery retaining member formed with spring arms for retaining a pair of batteries in spaced-apart relationship. Further included is a light bulb having a pair of leads extending therefrom and carried at one end of the housing with the leads each connected to a battery. Adjacent the opposite end of the housing a switch wire connected to one battery extends between the battery retaining member and a flexible wall of the housing. The other end of the switch wire is located adjacent a cutout portion of the battery retaining member which exposes a surface of the other of the batteries so that when the flexible wall of the housing is pressed the other end of the switch wire contacts the other of the batteries completing a circuit between the batteries and the light bulb.

11 Claims, 3 Drawing Figures

10
26b
47
36
46
20
34
32
3
22
44
62
18
38
28
60
48
26a
12
16
26c
2

FLASHLIGHT

This invention relates to flashlights and, more particularly, to relatively small, inexpensive flashlights easily carried in a purse or pocket. One currently available flashlight of this type is generally similar to that disclosed in U.S. Pat. No. 3,796,869, issued Mar. 12, 1974 to W. S. Stone and comprises a housing having a flexible wall in which is carried a battery holder formed with shallow channels in which a pair of batteries are adhesively secured. A light bulb is carried at one end of the housing and includes lead wires extending from the bulb which are soldered to one end of the batteries. One end of a switch wire is soldered to the other end of one of the batteries and the switch wire is arranged to be adjacent to, but normally spaced from, an exposed surface of the other battery. When is is desired to light the bulb, the outer flexible wall of the housing is pressed or squeezed causing the other end of the switch wire to contact the exposed surface of the other battery completing the circuit between the batteries and the bulb. While the flashlight described is generally satisfactory in use, it is time consuming to manufacture.

Accordingly, it is an object of this invention to provide a small, easily carried flashlight that is relatively inexpensive.

It is another object of this invention to provide a small flashlight that is easily assembled.

It is yet another object of this invention to provide a small flashlight including economical battery holding means and wire connections.

Finally, it is an object of this invention to provide a small flashlight having easily replaceable batteries.

These and other objects of this invention are accomplished by providing a flashlight comprising a housing having a generally flexible side wall, a battery retaining member located in the housing and formed with resilient arm members which removably retain a pair of batteries. At one end of the housing is carried a light bulb having leads extending therefrom and being in contact with first and second conductor members carried on the battery retaining member adjacent the one end of the housing. The first and second conductor members are also in contact with the end of the batteries adjacent the one end of the housing. A third conductor member is carried on the battery retaining member adjacent the other end of the housing and is in contact with the other end of one of the batteries and also with a switch wire extending from the third conductor member between the battery retaining member and adjacent the inner surface of the flexible wall of the housing. The switch wire terminates at a cutout portion of the battery retaining member adjacent an exposed surface of the other of the batteries and is normally spaced therefrom. When it is desired to light the flashlight, the flexible side wall of the housing is pressed forcing the switch wire into engagement with the exposed surface of the other battery completing the circuit between the light bulb and the batteries. It is noted that preferably the conductor members include sockets in which the leads and switch wires are inserted.

For a better understanding of the invention, reference is made to the following description of a preferred embodiment thereof taken with the figures of the accompanying drawing, in which.

Figures 1, 2, 3:
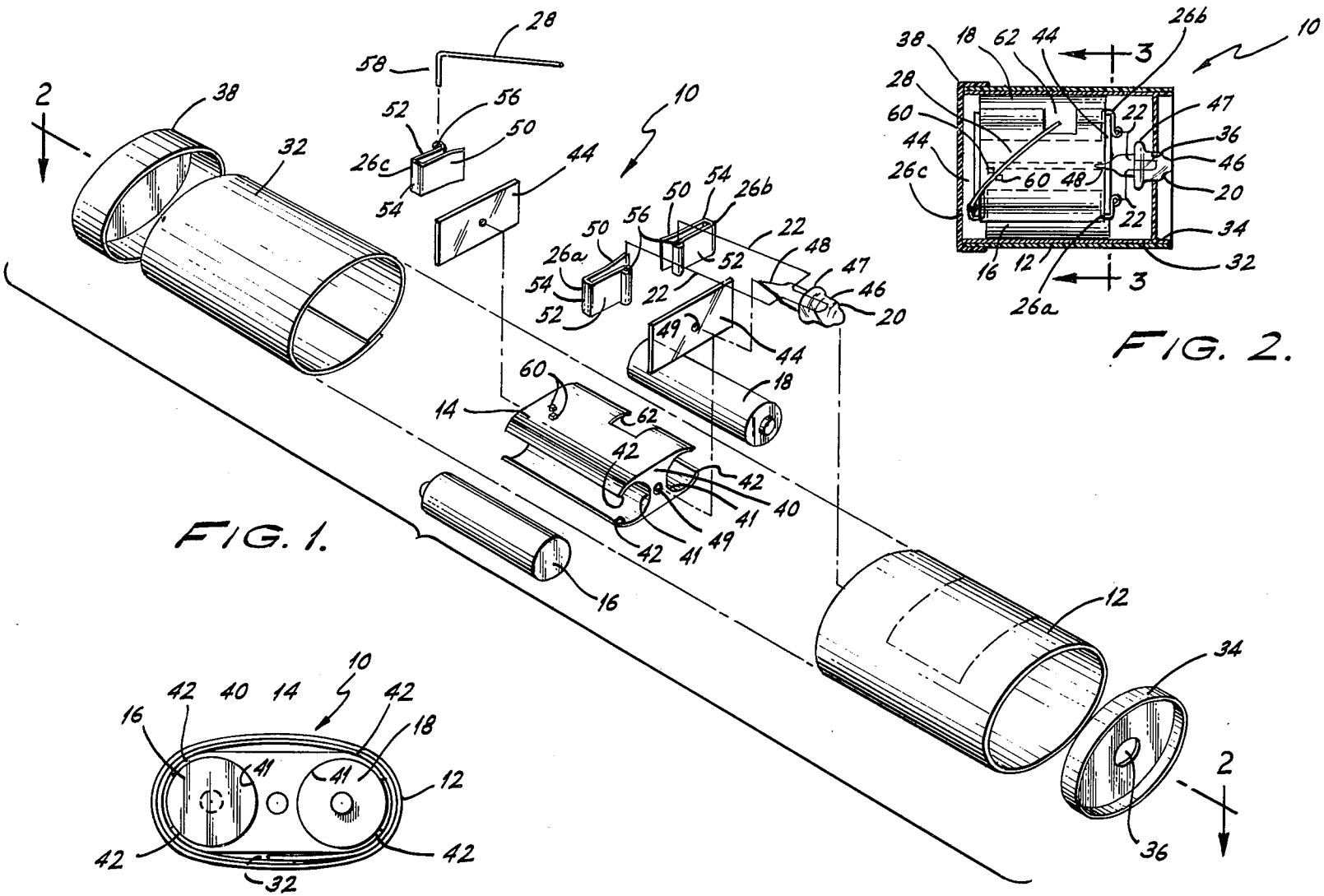
FIG. 1 is an exploded perspective view of a flashlight in accordance with this invention.
FIG. 2 is a partial sectional view of the flashlight illustrated in FIG. 1 shown in assembled condition; and, FIG. 3 is a sectional view taken along the line 3—3 of FIG. 2.

Referring now to the drawing, there is illustrated a flashlight 10 comprising a housing with a generally flexible side wall 12 in which carried a battery retaining member 14 for a pair of batteries 16 and 18. One end of the housing carries a light bulb 20 including lead wires 22, 22 extending from the filament into contact with a pair of conductor members **26*a*, 26*b* carried on the adjacent end of the battery retaining member 14 such that the conductor members 26*a* and 26*b* are also in contact with the batteries 16 and 18, respectively. A single conductor member 26*c* is carried on the opposite end of the battery support member 14 and is in contact with the battery 16 and also with a switch wire 28 extending upwardly along the outer surface of the battery retaining member 14 adjacent the side wall 12 and terminating adjacent to an exposed surface of the battery 18.**

As noted above the housing includes as generally flexible side wall 12 which in the preferred embodiment disclosed herein comprises the outer wall member of the housing and surrounds a flexible inner wall member 32. Both wall members are generally rectangular pieces of plastic, coated paper or some other similar flexible insulating material and are shaped to define a generally oval cross-sectional cavity. The outer wall member 12 is preferably transparent and the inner wall member 32 is opaque and may include indicia of any desired type, for example, advertising material. At the end of the wall members 12 and 32 adjacent the light bulb 20 there is provided a generally oval end wall member 34 adapted to seat against the inner surface of the outer wall member 12 and on the end of the inner all member 32. The end wall member 34 is retained in position by friction, or adhesives, can be heat fused or retained in any other desirable manner. An opening 36 is centrally formed in the end wall member and the light bulb 20 is adapted to project through the opening. If desired, the top outer surface of the end member 34 may be coated with a reflective material for dispersing and reflecting the light from the light bulb 20. The other end of the inner and outer wall members 12 and 32, respectively is received in an end closure member or cup 38 which is frictionally retained in place and easily removable. If desired the end closure member may also be adhesively secured in place.

The battery retaining member 14 is located inside the generally oval cavity, is formed of plastic or a similar resilient, insulating material and comprises a central body portion 40 extending longitudinally along the axis of the flashlight 10. Opposite sides of the body portion 40 are formed with arcuate surfaces 41 which provide a seat for the batteries 16 and 18. For retaining the batteries 16 and 18 in the seats 41, a pair of generally arcuate resilient arms 42 extend from each of the opposite sides of the body portion 40 and form with the adjacent seat 41, a channel having an arcuate length greater than one-half the circumference of a battery. The resilient arms 42 are generally elongated extending throughout the length of the body portion 40 and the longitudinal ends of each arm in a pair are spaced apart a sufficient distance to allow insertion of a battery. On each of the transverse end walls of the central body portion 40 there is provided an end plate 44 which, preferably, extends across the open ends of the channels formed by the arcuate surfaces 41 and resilient arms 42. The end plates 44 can be integrally formed with the central body portion 40 or can be separately formed and suitably secured to it. The latter arrangement is illustrated for purposes of clarity. The batteries 16 and 18 are generally conventional dry cell batteries without an insulating wrapper around the outer surface or casing.

The light bulb 20 is generally conventional and has a dome portion 46, an enlarged diameter portion 47 and reduced diameter tip portion 48 which seats in aligned opening 49 in the end plate 44 and in the central body portion 40. The dome portion 46 extends through the opening 36 wall member 34 and the enlarged diameter portion 47 bears on the inner surface of the end wall member whereby the light bulb is retained in position.

The conductor members 26*a, b* and *c* are generally similar and are generally U-shaped clip members made of resilient conductive material. Each conductor member includes a pair of adjacent leg members 50 and 52 joined by a transverse leg member 54. The free end of the leg members 52 are also formed with a circular scroll portion 56 providing a socket extending transversely of the associated leg member. In use the conductor members fit over the end plates 44 and are retained by a light spring force exerted by the clip configuration. As noted previously, two of the conductor members 26*a* and 26*b* are located adjacent the light bulb 20 and accordingly, these clips fit over the end plate 44 adjacent the light bulb. Thus arranged, the end of the casing of battery 16 contacts the leg member 50 of the conductor member 26*a* and the positive post of the battery 18 contacts the leg member 50 of the conductor member 26*b*. The lead wires 22 extending from the light bulb 20 are inserted into the sockets formed by the scroll portions 56 of each conductor member 26*a* and 26*b* to provide a connection from the light bulb to the batteries. It should be understood that the sockets could be formed by configurations other than the scroll 56.

The third conductor member 26*c* is similarly retained on the end plate 44 opposite the light bulb 20 such that the positive post of the battery 16 contacts the leg member 50 of this conductor member. To connect the batteries, the switch wire 28 is formed with an angularly extending portion 58 which fits into the socket formed by the scroll 56 of the conductor member 26*c*. The switch wire 28 which is a conductor extends across the battery retaining member 44 adjacent the inner surface of inner wall member 32 and is centered between a pair of guide nibs 60, 60 formed on the central body portion 40. The spring arm 42 adjacent the battery 18 is formed with a cutout portion 62 exposing the conductive outer surface of that battery. The switch wire 28 terminates adjacent the cutout portion 62 and is normally spaced from the exposed surface of the battery 18 by the thickness of the spring arm 42.

When the flashlight is assembled as illustrated in FIG. 2 of the drawing, and when it is desired to light the light bulb 20, it is merely necessary to squeeze the opposite sides of the outer wall member 12. The force thus exerted moves the inner wall member 32 toward the batteries 16 and 18 exerting force on the switch wire 28 adjacent to the cutout portion 62. This force pushes the switch wire 28 into contact with the exposed surface of the battery 18 completing the electrical circuit between the light bulb 20 and the batteries 16 and 18 which, of course, energizes the light bulb.

From the preceding description of a preferred embodiment of the invention, it can be seen that a flashlight has been provided that is relatively economical to manufacture requiring no soldering or adhesives during the manufacturing operation. In addition, it can be realized that the batteries 16 and 18 can be easily replaced which extends the useful life of the flashlight.

If desired, the end plates 44 and conductor clips 26*a* 26*a* and 26*c* may be eliminated and the wires from the lamp may be connected to the batteries in any conventional manner. Also, the switch wire 28 may be connected to the one battery terminal either by soldering or by having a loop formed in one end and pressed over the battery terminal. With this arrangement, the batteries would not be replaceable but the flashlight could still be assembled easily and efficiently.

While in the foregoing, a preferred embodiment of the invention has been described, it should be understood that one skilled in the art that various modifications and changes can be made without departing from the true spirit and scope of the invention as recited in the appended claims.

We claim:

1. A flashlight comprising a housing having a generally flexible side wall, a battery retaining member in said housing including resilient arm members removably retaining a pair of batteries in spaced-apart relationship, said battery retaining member being made of an insulating material, a light bulb including housing, first and second conductor means carried on said battery retaining member adjacent said one end of said housing, each of said first and second conductor means being in contact with one of said leads and with one of said batteries, a third conductor means carried on said battery retaining member adjacent the other end of said housing, said third conductor means being in contact with a conductive switch wire and with one of said batteries, said switch wire extending along said battery retaining member and being adjacent said side wall of said housing, said switch wire terminating adjacent to an exposed conductive surface of the other of said batteries and being normally spaced therefrom, whereby when said side wall of said housing is pressed said switch wire contacts said exposed conductive surface of said other battery completing a circuit between said batteries and said light bulb.

2. A flashlight in accordance with claim 1 wherein said battery retaining member comprises an elongated central body portion extending generally from said one end of said housing to said other end of said housing, said body portion having a pair of said arm members extending from opposite sides thereof to form channels in which said batteries are retained.

3. A flashlight in accordance with claim 2 wherein one of said arm members includes a cutout portion providing said exposed surface of said other battery.

4. A flashlight in accordance with claim 1 wherein said battery retaining member includes a cut out portion providing said exposed surface of said other battery.

5. A flashlight in accordance with claim 1 wherein said first, second and third conductor means comprise a clip member made of conductive material and removably attached to said battery retaining member.

6. A flashlight in accordance with claim 5 wherein said clip members include a generally U-shaped member in crossection formed with a socket in which said leads and switch wire are inserted.

7. A flashlight in accordance with claim 6 wherein said sockets are formed by a scroll extending in a transverse direction.

8. A flashlight in accordance with claim 1 wherein said battery retaining member includes a transverse end plate at each end thereof and wherein said first and second conductor means comprises generally U-shaped clip members attached to the plate at the said one end of said housing, said leads being connected to said clip member and wherein a single generally U-shaped clip member is attached to the end plate at said other end thereof and wherein said switch wire is connected to said single clip member.

9. A flashlight in accordance with claim 1 wherein said battery retaining member is formed with guide nibs between which said switch wire is located.

10. A flashlight comprising a housing having a generally flexible side wall, a battery retaining member in said housing including resilient arm members resiliently retaining a pair of batteries in spaced apart relationship, said retaining member and resilient arm members being made of an insulating material and encircling and covering a major portion of each of the batteries, a cutout portion in one arm member exposing a conductive surface of one battery, a resilient conductive switch member, socket means electrically connecting said switch member to a terminal of the other battery, said switch member extending between the housing and battery retaining member and terminating at said cutout thereby overlying and being normally spaced from the conductive surface of said one battery, a light bulb including a pair of leads electrically connected with said batteries.

11. A flashlight comprising a housing having a generally flexible sidewall, a battery retaining member in said housing including resilient arm members removably retaining a pair of batteries in spaced-apart relationship, a light bulb including a pair of leads extending therefrom carried at one end of said housing, first and second conductor means carried on said battery retaining member adjacent said one end of said housing, each of said first and second conductor means being in contact with one of said leads and with one of said batteries, third conductor means carried on said battery retaining member adjacent the other end of said housing, said third conductor means being in contact with a conductive switch wire and with one of said batteries, said switch wire extending along said battery retaining member and being adjacent said side wall of said housing, said conductive switch wire terminating adjacent to an exposed surface of the other of said batteries and being normally spaced therefrom, whereby when said side wall of said housing is pressed said switch wire contacts the exposed surface of said other battery completing a circuit between said batteries and said light bulb, said first, second and third conductor means each comprising a generally U-shaped clip member made of conductive material and formed with a socket, said leads being inserted in the sockets in said first and second conductor means and said switch wire being inserted in the socket in said third conductor means, said battery retaining member including a transverse end plate at each end thereof, said clip members being attached to said end plate with one leg overlying opposite faces thereof and being resiliently retained thereon.

* * * * *

UNITED STATES PATENT OFFICE

CERTIFICATE OF CORRECTION

Patent No. 4,032,773 Dated June 28, 1977

Inventor(s) Richard L. Halliday, Jr., Robert R. Anderson, Richard L. Halliday

It is certified that error appears in the above-identified patent and that said Letters Patent are hereby corrected as shown below:

Column 1, line 17, "is", first occurrence should be --it--.

Column 2, line 7, after "which" insert --is--.

Column 3, line 14, after "36" insert --in the end--.

Claim 6, line 3, correct the spelling of "cross-section".

Signed and Sealed this

First Day of November 1977

[SEAL]

*Attest:*

RUTH C. MASON
*Attesting Officer*

LUTRELLE F. PARKER
*Acting Commissioner of Patents and Trademarks*